United States Patent [19]

Simmons

[11] 4,239,079

[45] Dec. 16, 1980

[54] SAND DEFLECTOR FOR AUTOMATIC MOLDING MACHINE

[76] Inventor: Joseph Simmons, R.D. 1, Box 163A, Morgantown, Pa. 19543

[21] Appl. No.: 43,839

[22] Filed: May 30, 1979

[51] Int. Cl.[3] ..... B22C 15/24; B22C 21/12

[52] U.S. Cl. ..... 164/200; 164/374; 249/122; 249/142; 249/160; 425/175; 425/542; 425/580; 425/584

[58] Field of Search ..... 164/200–203, 164/160, 207, 243, 374; 425/175, 542, 580, 584; 249/142, 160, 122

[56] References Cited

U.S. PATENT DOCUMENTS

| | | | |
|---|---|---|---|
| 2,864,134 | 12/1958 | Harrison | 164/165 |
| 2,899,724 | 8/1959 | Peterson | 164/202 |
| 3,460,607 | 8/1969 | Olson | 164/200 |
| 3,556,196 | 1/1971 | Buhler | 164/160 |
| 3,659,642 | 5/1972 | Vasilkousky | 164/202 |
| 3,726,954 | 4/1973 | Munk et al. | 164/200 |
| 3,744,549 | 7/1973 | Buhler | 164/160 |
| 3,760,866 | 9/1973 | Larkin | 164/207 |
| 3,878,881 | 4/1975 | Lund et al. | 164/37 |
| 3,970,139 | 7/1976 | Grolla | 164/253 |
| 4,142,888 | 3/1979 | Rozmus | 249/160 |

*Primary Examiner*—W. E. Hoag
*Attorney, Agent, or Firm*—Fleit & Jacobson

[57] ABSTRACT

A deflector for use on an automatic molding machine deflects incoming sand downwardly onto the drag table and then upwardly into deep recesses in the pattern. The sand deflector is formed as a rectangular prism from a single block of metal, and has two deflecting channels separated by a strengthening septum. The channels are arranged at a predetermined angle in relation to the mounting surface of the deflector.

6 Claims, 3 Drawing Figures

SAND DEFLECTOR FOR AUTOMATIC MOLDING MACHINE

The present invention relates to a deflector for use with an automatic molding machine and, more specifically, to a deflector for deflecting the sand in an automatic molding machine to prevent sand pack off.

The advantages provided by automatic molding machines in producing molds used for sand castings are well known. These automatic machines operate to produce a sand mold from a pattern in an efficient and accurate manner.

One type of automatic molding machine operates to blow the sand into the cope and the drag of the machine, so that the two mold sections are formed automatically and simultaneously. Typical of this type of machine is the Beardsley & Piper automatic molding machine.

Even though these automatic machines have many benefits, there are nevertheless, drawbacks. Not the least of these drawbacks is that the automatic machine cannot always pack sand into patterns having deep pockets. In order to produce the desired molds from such deep-pocket patterns, alternate techniques must be used, in place of the automatic molding machine.

SUMMARY OF THE INVENTION

The present invention provides a unitary sand deflector having a specialized angle. The sand deflector may be formed of a solid piece of ductile iron. The deflector is affixed to the moveable drag flask and serves to deflect the incoming sand down onto the tableplate of the drag flask and up into the pattern. A brace is provided at the approximate center of the deflector, in order to make the deflector more rigid. This brace prevents deformation of the deflector, which would permit high-pressure sand to escape. It has been found through experimentation, that optimum performance of the sand deflector is obtained when it is formed having an angle of 19°.

Therefore, it is an object of the present invention to provide a sand deflector for use in automatic molding machines.

It is another object of the present invention to provide a sand deflector formed of a single piece of ductile iron.

It is a further object of the present invention to provide a sand deflector having a specialized deflection angle.

It is still a further object of the present invention to provide a sand deflector having a specialized deflection angle and being formed with a center brace to prevent deformation of the deflector.

The manner in which these and other objects are accomplished by the present invention will be seen more clearly from the following detailed description.

DETAILED DESCRIPTION OF THE INVENTION

Figure 1:
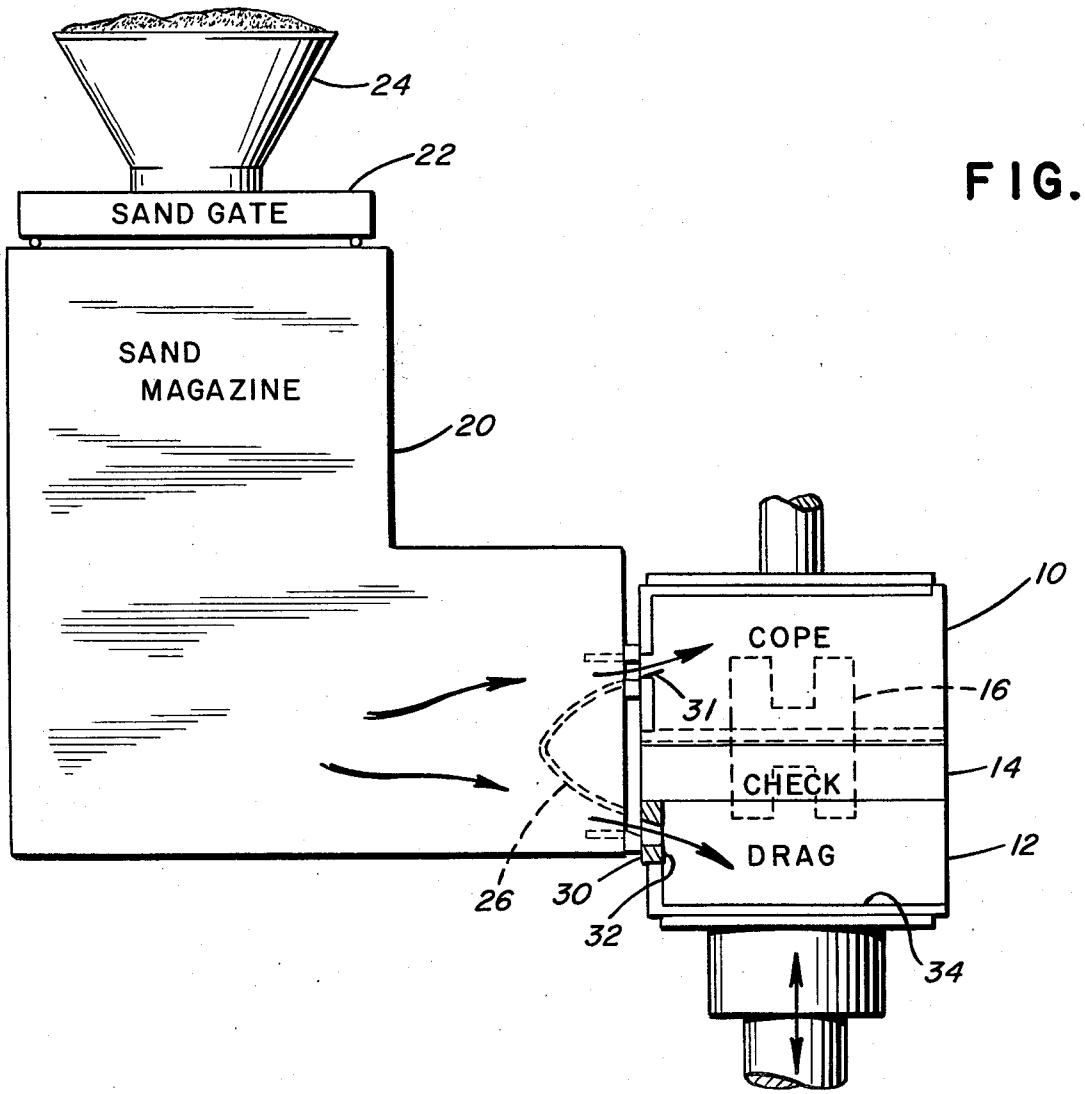
FIG. 1 is a diagrammatic view partially in section of the interior of an automatic molding machine, having the inventive deflector installed thereon.

FIG. 1 shows the interior of a typical automatic molding machine in a diagrammatic view. The molding machine is provided with the conventional cope 10 and drag 12. The cope 10 is held in a fixed position and the drag 12 operates to move up and down, in the well-known manner. Between the cope 10 and the drag 12 is a check 14 and, as may be seen, the pattern 16 is then arranged interior to the cope 10, the check 14 and the drag 12. The pattern is shown in phantom at 16. This typical molding machine employs a sand magazine 20, which has a sand gate 22 for permitting the supply of sand to be fed into the sand magazine by a large chute 24 from the sand supply. A high-pressure air supply is connected to the sand magazine and, in this manner, the sand is blown into both the cope 10 and the drag 12. An interior baffle plate 26 is typically provided to aid in directing the sand into the cope and the drag 12.

The inventive sand deflector 30 is affixed to the drag flask at 32. The inventive deflector 30 is shown in a cross section and will be shown in more detail in FIGS. 2 and 3.

Nevertheless, as seen in FIG. 1, the inventive deflector 30 is formed with an angled channel, which serves to direct the sand being blown from the sand magazine 20 into the drag 12 in a downwardly fashion, so as to cause the sand to impinge directly onto the drag table 34. The effect of this is to cause the sand to be reflected upwardly from the drag table 34 and into the pattern 16 and, specifically, into the deep recesses of the pattern.

An additional deflector is also provided in regard to the stationary cope flask. The additional deflector functions much the same way as does the inventive deflector 30. This additional deflector is formed of a strip 31 of specialty steel and cooperates with the baffle 26 to pack sand into deep pockets in the pattern. The deflector 31 can be advantageously formed of manganal steel, a special hardened steel, and on the embodiment described is 16 inches long and 1¼ inches wide. The additional deflector 31 is fastened to the baffle 26 at an upwardly directed angle of 19° with the horizontal, so as to direct the sand to the top, thereby forcing it into the pattern.

In FIG. 1, assuming that the inventive sand deflector 30 is absent, the sand will enter into the drag 12 in a manner which is identical to the manner in which it enters the cope 10. Thus it may be seen that the machine must rely solely upon the air pressure to cause the sand to be deposited in the deep recesses of the pattern 14.

Figure 2:
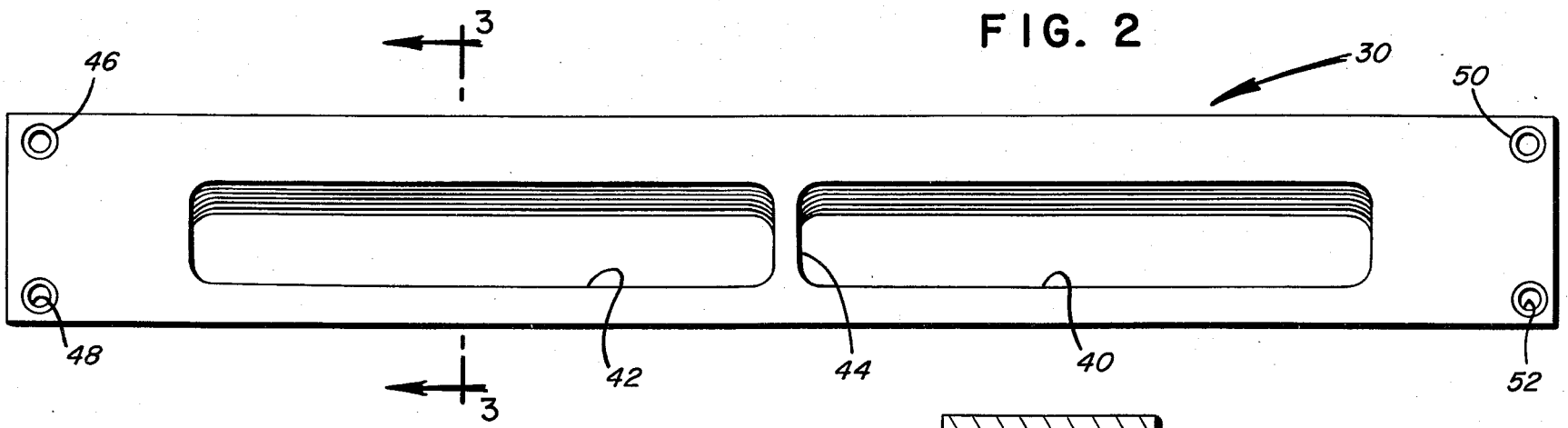
FIG. 2 is a side elevation view of the inventive sand deflector.

FIG. 2 is a side elevation view of the inventive sand deflector 30. The sand deflector 30 is formed having two slots or deflecting channels, 40 and 42, which are formed by the septum 44, which serves to brace and strengthen the sand deflector. The sand deflector is preferably formed of a single solid piece of ductile iron. It may be cast or machined into its final form. The embodiment shown in FIG. 2 is approximately twenty-two inches long, three inches wide, and one inch thick. Four mounting holes, 46, 48, 50 and 52, are provided for attaching the sand deflector 30 to the drag flask 32 of FIG. 1.

The surface of the sand deflector 30 should be polished to a number four finish to eliminate any possibility of adherence of the sand to the deflector. As indicated in FIG. 1, the two channels, 42 and 40, are formed at an angle through the deflector, and this is shown specifically in FIG. 3.

Figure 3:
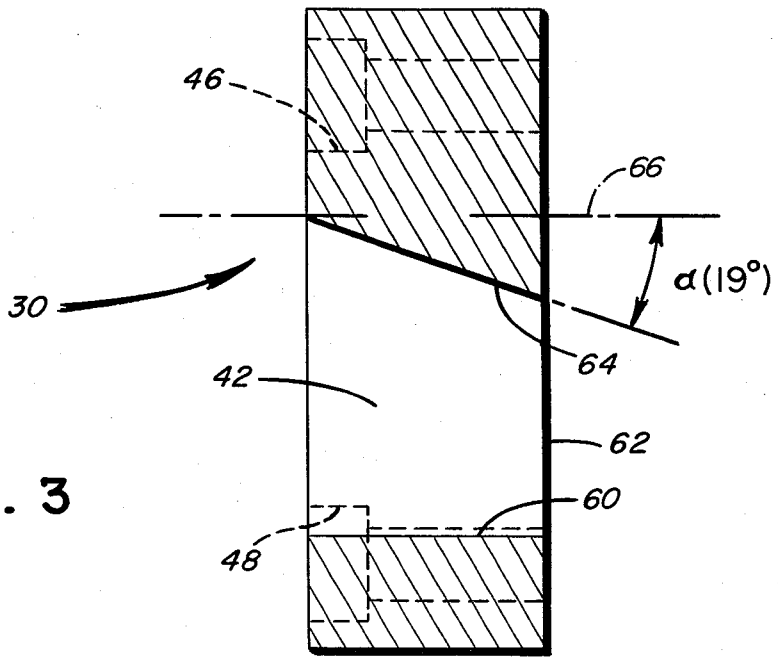
FIG. 3 is a cross section of the inventive sand deflector, taken along line 3—3 of FIG. 2.

In FIG. 3, the sand-inlet duct or channel 42 is arranged through the inventive sand deflector 30, with one wall 60 arranged perpendicularly to the mounting surface 62 of the sand deflector and the other wall 64 of the slot 42 arranged at an angle with the mounting surface 62. Surface 64 may be thought of as forming an angle $\alpha$ with a reference line 66. The reference line 66 is perpendicular to the vertical mounting surface 62 of the deflector 30. During the course of development of the inventive sand deflector, it has been found, in the Beardsely & Piper BSM 2016 Match Blomatic machine, that when the angle $\alpha$ is equal to 19° the inventive sand deflector acts to produce optimum molds. Although the angle of 19° is the optimum one for that particular machine, other angles may be found to provide superior results in other machines. Additionally, although this angle is the optimum angle for the specific machine discussed above, it has been found that slight variations from this angle will still produce acceptable results, although such results will not be the optimum.

It has also been found during development that using the 19° angle causes the sand to pack better into the pattern, thereby ultimately making smoother castings. Of course, as indicated above, the inventive sand deflector prevents sand from packing off in deep recesses of the pattern, which serves to eliminate scrap castings due to incorrectly formed molds.

Therefore, it may be seen that by using the inventive sand deflector, having an angle of 19° on a Match Blomatic machine, that patterns having deep recesses may be employed to automatically produce the desired molds, with no fear that the sand will not reach the deeper recesses of the pattern.

It is understood, of course, that the foregoing description is presented by way of example only and is not intended to limit the scope of the present invention, except as set forth in the appended claims.

What I claim is:

1. Apparatus for use on an automatic molding machine of the type for making a mold of a pattern by blowing sand through outlet passageways of a sand magazine into a fixed cope and a movable drag, said apparatus comprising a deflector mounted on said movable drag below an upper edge thereof and extending into the interior thereof, said deflector being a rectangular prism and having at least one sand inlet channel through said prism arranged at an angle of 19° in relation to a reference line perpendicular to a surface (62) on said deflector used for mounting said deflector in said drag, whereby sand passing from the outlet passageway of the sand magazine through the at least one sand inlet channel is deflected downwardly onto the floor of the drag and then upwardly into said pattern.

2. The apparatus of claim 1, wherein said sand deflector is provided with two said inlet channels separated by a septum, which serves to make said deflector rigid.

3. The apparatus of claim 1, wherein said deflector is formed of a single piece of ductile iron.

4. The apparatus of claim 1, wherein the surface of said deflector is polished to a number four finish.

5. In an automatic molding machine for making a sand mold of a pattern of the type having:

(a) a fixed cope, (b) a movable drag, which cooperates with the cope to enclose the pattern, (c) a sand magazine having outlets communicating with said cope and said drag, and (d) a source of pressurized sand which blows the sand through the outlets into the cope and drag, which enclose the pattern, the improvement wherein:

the movable drag is provided with a deflector mounted thereon below an upper edge thereof and extending into the interior thereof, for deflecting incoming blown sand in a downward direction so that the sand is reflected upwardly into the pattern, said sand deflector being formed as a rectangular solid body having a channel arranged therein through which the blown sand passes, said channel being arranged in said deflector at an angle of 19° in relation to a reference line perpendicular to a surface (62) on said deflector, whereby said deflector is mounted to said drag.

6. The improvement of claim 5, wherein said deflector is formed as a rectangular elongate prism wherein two channels are arranged from one elongate side to the opposite elongate side, said sand passing through said two channels into said drag.

* * * * *